US007793463B1

(12) United States Patent
Stansberry et al.

(10) Patent No.: US 7,793,463 B1
(45) Date of Patent: Sep. 14, 2010

(54) PLANTATION STYLE SECURITY SHUTTERS

(75) Inventors: Warren W. Stansberry, Phoenix, AZ (US); Bradley D. Carlson, Glendale, AZ (US); Jeffrey C. Heidel, Glendale, AZ (US)

(73) Assignee: Cline Labs, Inc., Phoenix, AZ (US)

( * ) Notice: Subject to any disclaimer, the term of this patent is extended or adjusted under 35 U.S.C. 154(b) by 690 days.

(21) Appl. No.: 11/805,214

(22) Filed: May 22, 2007

(51) Int. Cl.
*E05C 9/00* (2006.01)

(52) U.S. Cl. ..... 49/395; 49/61; 49/67; 49/367; 292/143; 292/145; 292/302

(58) Field of Classification Search ..... 49/61, 49/63, 64, 67, 50, 56, 366, 367, 394, 395; 52/202, 203; 292/137, 143, 145, 146, 150, 292/302
See application file for complete search history.

(56) References Cited

U.S. PATENT DOCUMENTS

| | | | | | |
|---|---|---|---|---|---|
| 892,819 | A * | 7/1908 | Fischer | 49/68 |
| 900,794 | A * | 10/1908 | Stoppels | 292/160 |
| 2,718,039 | A * | 9/1955 | Dube | 49/388 |
| 3,183,547 | A * | 5/1965 | Bury | 16/238 |
| 3,333,878 | A * | 8/1967 | Pelcin | 292/37 |
| 3,949,525 | A * | 4/1976 | Bates et al. | 49/395 |
| 4,265,051 | A * | 5/1981 | Williams | 49/7 |
| 4,384,428 | A * | 5/1983 | Cox | 49/56 |
| 4,631,862 | A * | 12/1986 | Gallardo | 49/56 |
| 4,796,384 | A * | 1/1989 | Warwick | 49/55 |
| 5,061,022 | A * | 10/1991 | Meriwether | 312/324 |
| 5,419,085 | A * | 5/1995 | Imbur | 49/398 |
| 5,464,281 | A * | 11/1995 | Maro | 312/257.1 |
| 5,490,353 | A * | 2/1996 | McLaughlin | 49/64 |
| 5,657,578 | A * | 8/1997 | Thompson | 49/141 |
| 6,021,608 | A * | 2/2000 | Ollison | 49/449 |
| 6,923,028 | B2 * | 8/2005 | Caldwell et al. | 70/56 |
| 6,935,082 | B2 * | 8/2005 | Hemstreet et al. | 52/473 |
| 7,370,890 | B2 * | 5/2008 | Samsel | 292/42 |
| 2004/0000794 | A1 * | 1/2004 | Wang | 292/143 |
| 2004/0035056 | A1 * | 2/2004 | Briscoe et al. | 49/67 |
| 2008/0127565 | A1 * | 6/2008 | Taylor | 49/394 |
| 2009/0090062 | A1 * | 4/2009 | Pandorf | 49/50 |

* cited by examiner

*Primary Examiner*—Jerry Redman
(74) *Attorney, Agent, or Firm*—William E. Hein

(57) ABSTRACT

A shutter assembly includes left and right shutter doors hingedly mounted between upper and lower horizontal frame members secured over an opening to be shuttered. Vertical stiles serve as the left and right frame members of each of the shutter doors. The vertical stile on the unhinged side of one of the shutter doors includes a vertical flange that engages and secures the vertical stile on the unhinged side of the other shutter door when both doors are closed and locked. The two vertical stiles framing each door retain left and right pivot strips to which a plurality of louvers are mounted for rotation. A louver tilt rod mechanism is attached to and hidden from view behind one of the vertical styles of each of the doors and operates to mechanically link the louvers for movement in concert. A wire rope is positioned longitudinally within each of the louvers to prevent a breach of the shutter assembly through attempted bending of the louvers. The wire rope acts also serves to deter sawing of the louvers by its tendency to rotate and also to bind a saw blade that contacts it. A dual shot pin latching mechanism is vertically positioned between a latch socket block and a latch actuator block mounted to the framework of the opening to be shuttered behind the upper and lower horizontal frame members, respectively, to secure the shutter doors in their closed position.

16 Claims, 7 Drawing Sheets

PLANTATION STYLE SECURITY SHUTTERS

BACKGROUND AND SUMMARY OF THE INVENTION

This invention relates generally to security shutters and, more particularly, to security shutters that present the appearance of high quality plantation style shutters.

Historically, window security has been accomplished by installing fixed or movable locking bars or grating on the exterior of windows to be secured against forced entry or by installing a roll-up type of security barrier resembling a garage door. These prior art devices, while effective in providing window security, are restrictive in the event an emergency exit is required and are usually quite unattractive.

It would, therefore, be advantageous to provide an attractive plantation style shutter that is secure against forced entry, that permits the unrestricted flow of air through the shutter when in the open position, and that allows exit in an emergency.

In accordance with the illustrated preferred embodiment of the present invention, a shutter assembly includes left and right shutter doors hingedly mounted between upper and lower horizontal frame members secured over an opening to be shuttered. Vertical stiles serve as the left and right frame members of each of the shutter doors. The vertical stile on the unhinged side of one of the shutter doors includes a vertical flange that engages and secures the vertical stile on the unhinged side of the other shutter door when both doors are closed and locked. The two vertical stiles framing each door retain left and right pivot strips to which a plurality of louvers are mounted for rotation. A louver tilt rod mechanism is attached to and hidden from view behind one of the vertical styles of each of the doors and operates to mechanically link the louvers for movement in concert. A wire rope is positioned longitudinally within each of the louvers to prevent a breach of the shutter assembly through attempted bending of the louvers. The wire rope also serves to deter sawing of the louvers by its tendency to rotate and also to bind a saw blade that contacts it. A dual shot pin latching mechanism is vertically positioned between a latch socket block and a latch actuator block mounted to the framework of the opening to be shuttered behind the upper and lower horizontal frame members, respectively, to secure the shutter doors in their closed position.

DESCRIPTION OF THE PREFERRED EMBODIMENT

Figure 1B:
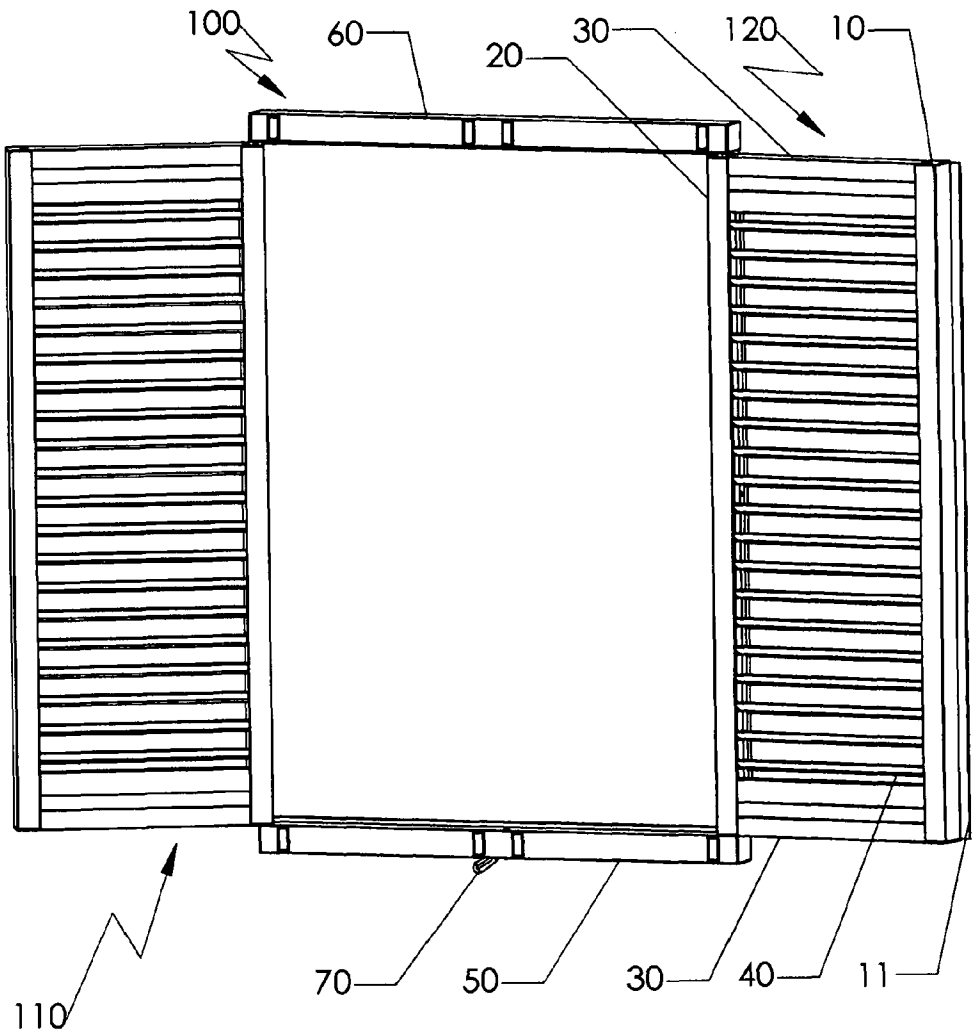
FIG. 1B is a pictorial diagram illustrating the shutter assembly of FIG. 1A with the shutter doors in the open and unlocked position.
Figure 1A:
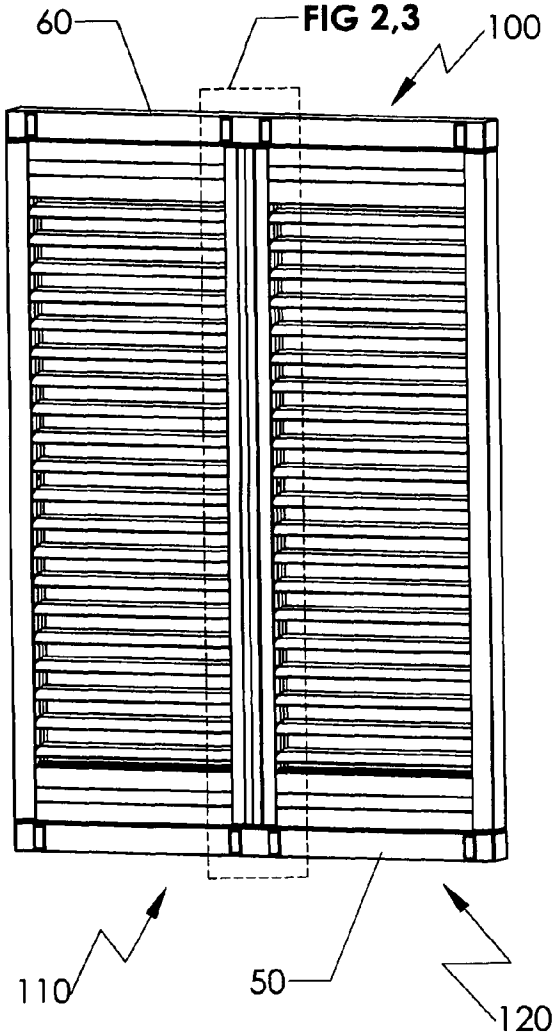
FIG. 1A is a pictorial diagram illustrating a shutter assembly constructed according to the present invention, with the shutter doors shown in the closed and locked position.

Referring now to FIGS. 1A and 1B, there is shown a metal security shutter assembly 100 that includes left and right metal shutter doors 110, 120, respectively, shown closed in FIG. 1A and open in FIG. 1B. Shutter doors 110, 120 are hingedly mounted between lower and upper horizontal metal frame members 50, 60, respectively, which are in turn mounted inside a building over an opening to be shuttered. The left and right sides of shutter doors 110, 120 are referred to herein as viewed from inside the building in the closed position illustrated in FIG. 1A. A vertical metal lock stile 10 along the left side of shutter door 120 includes a heavy vertical flange 11 that serves to engage and secure the left shutter door 110 when shutter doors 110, 120 are closed and locked. In addition, vertical stile 10 retains one of two vertically-positioned pivot strips to which a plurality of metal louvers 40 are mounted for rotation. A second vertical stile 20 along the right side of shutter door 120 retains the other pivot strip and the female portions of hidden door hinges. Vertical stiles 10, 20 are retained in their vertical positions by attachment to a horizontal rail 30 at the top and bottom of shutter door 120. The lower and upper horizontal frame members 50, 60 are solidly attached to the framework of the opening to be shuttered and provide the male portions of the hidden door hinges and also the latching mechanism and receiver for a dual shot pin locking mechanism. As illustrated in FIG. 1B, a latch handle 70 provides a visual indication when the shutter doors 110, 120 are not locked.

Figure 2:
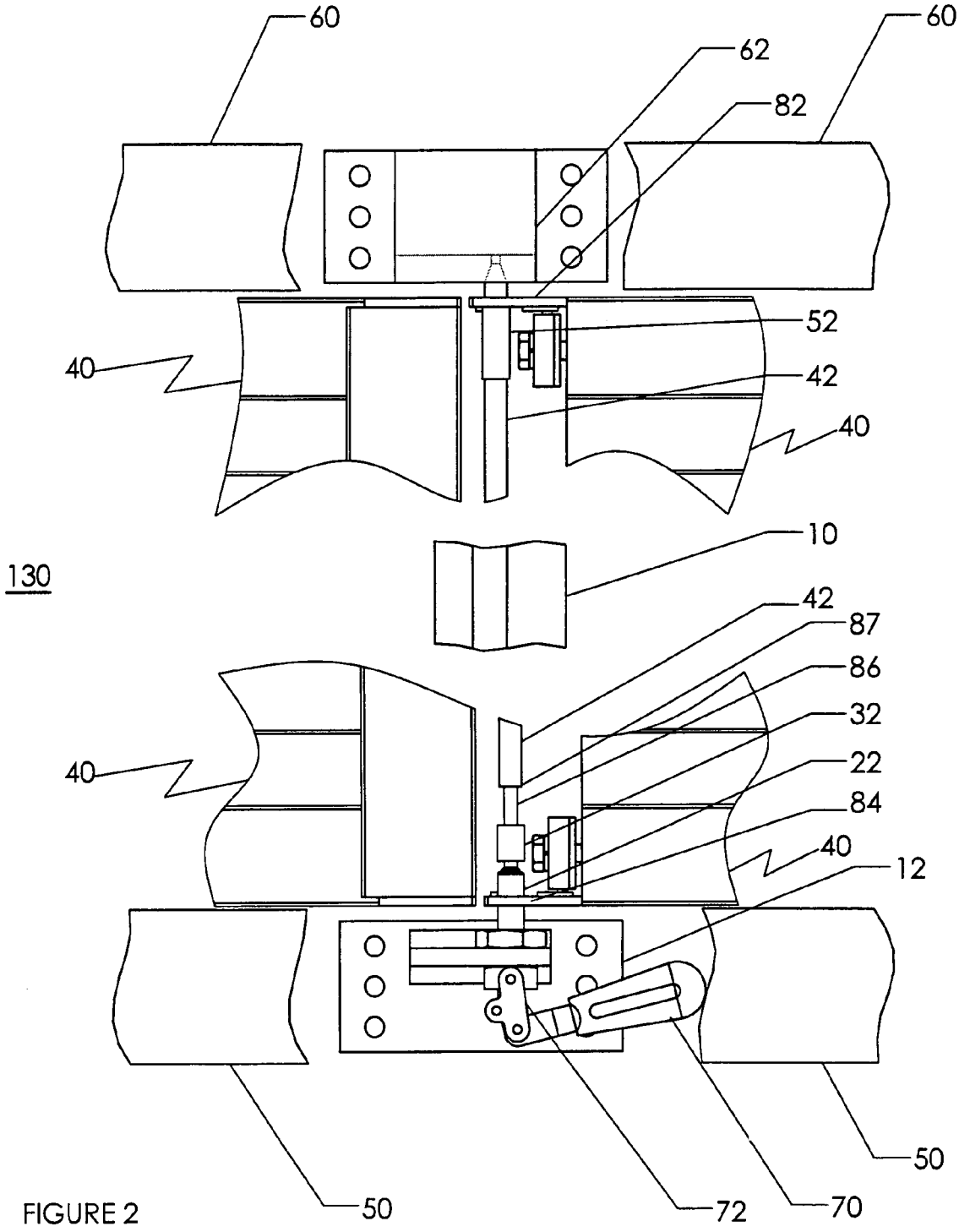
FIG. 2 is a detailed cutaway diagram of the shutter assembly of FIGS. 1A-B illustrating the upper and lower portions of a shutter locking mechanism when the shutters are in the closed and locked position.

Referring now to FIG. 2, there are shown the details of a latching mechanism 130 for securing shutter doors 110, 120 of shutter assembly 100 in the closed and locked position of FIG. 1A. A latch socket block 62 is concealed behind upper horizontal frame member 60, and a latch actuator block 12 is concealed behind lower horizontal frame member 50. Latch blocks 12, 62 are positioned in general vertical alignment. Both latch socket block 62 and latch actuator block 12 are secured to the framework of the opening to be shuttered so as to be covered by frame members 60, 50, respectively. Latch blocks 12, 62 are centrally positioned along the horizontal length of frame members 60, 50. A vertical shot pin 42, actuated by latch handle 70, extends upward from latch actuator block 12 and is guided at its upper end through a bearing sleeve 52 attached to vertical stile 10 for passage through an opening in an end cap 82. In order to lock shutter doors 110, 120, a plunger 22 of latching mechanism 130 lifts the shot pin 42 into engagement with a shot pin socket located within latch socket block 62. During the same upward motion, plunger 22 passes through an opening in an end cap 84 and into an aligned opening in vertical stile 10. A lower end 86 of shot pin 42, having a reduced diameter, is guided through a bearing sleeve 32, also attached to vertical stile 10. Plunger 22 is coupled to a conventional over-center mechanical linkage 72 attached to latch actuator block 12. The over-center mechanical linkage 72 is controlled by latch handle 70 to provide upward and downward motion of plunger 22. Plunger 22 engages the lower end 86 of shot pin 42 as it passes upward through a circular opening in end cap 84 and into the aligned opening in vertical stile 10. Latch handle 70 is concealed from view behind lower horizontal frame member 50 when shutters 110, 120 are in the closed and locked position of FIG. 1A. Access to latch handle 70 is gained through an opening in the bottom of horizontal frame member 50.

Figure 3:
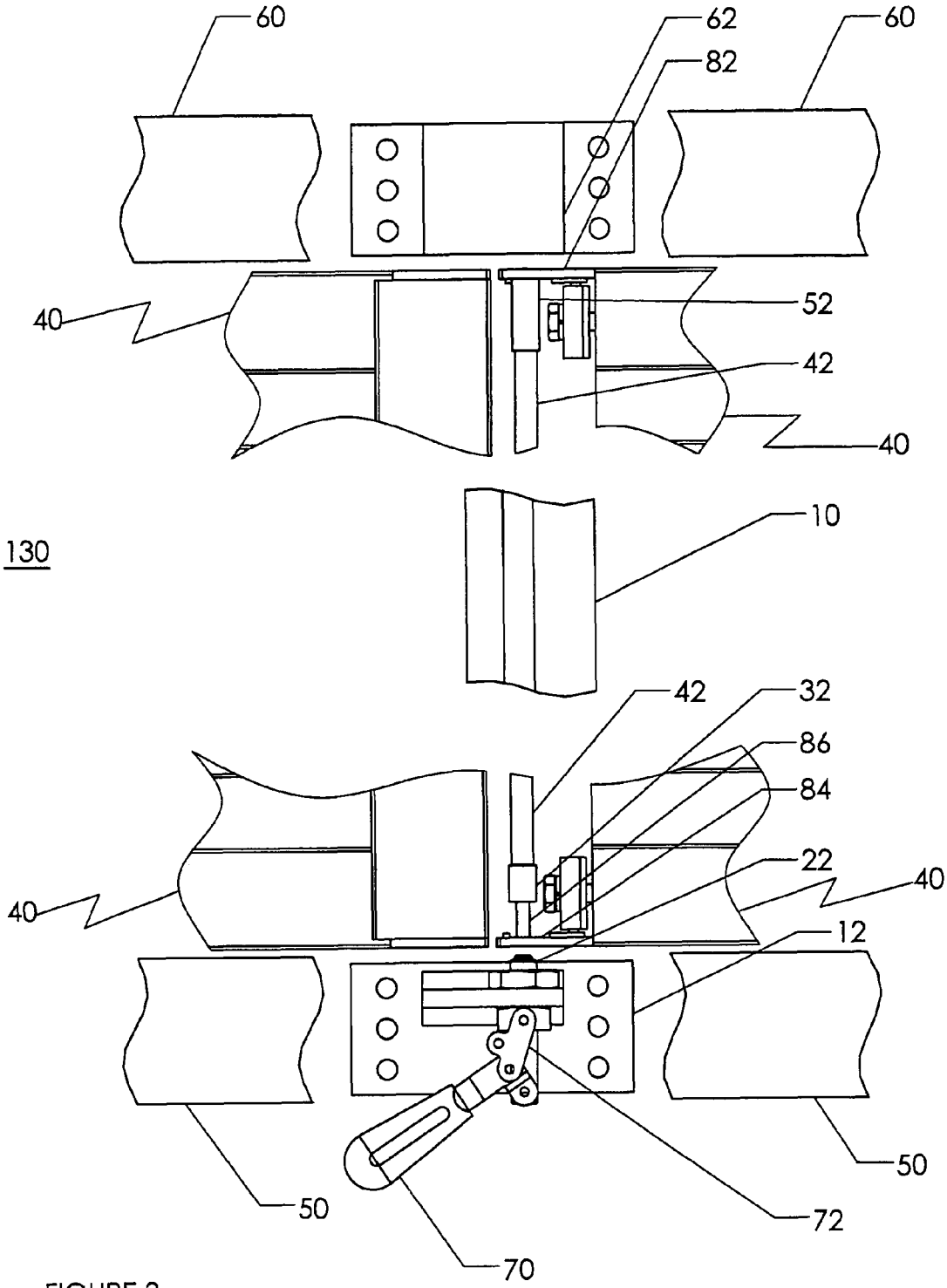
FIG. 3 is a detailed cutaway diagram of the shutter assembly of FIGS. 1A-B illustrating the upper and lower portions of the shutter locking mechanism of FIG. 2 when the shutters are in the open and unlocked position.

Referring now to FIG. 3, it may be seen that by moving latch handle 70 from its closed position shown in FIG. 2 to its open position shown in FIG. 3, plunger 22 moves away from its previous engagement with the bottom end of shot pin 42 and continues its downward motion out of the opening in end cap 84. Shot pin 42 is thus permitted to drop gravitationally so that its top end becomes retracted from the shot pin socket within latch socket block 62. In this position, a shoulder 87, illustrated in FIG. 3 as being formed by the reduced diameter of the bottom end 86 of shot pin 42, rests on the bearing sleeve 32 to prevent shot pin 42 from falling through vertical stile 10. As previously stated, the position of latch handle 70 illustrated in FIG. 3 serves as a visual warning to the user that shutter doors 110, 120 are not locked.

Figure 4:
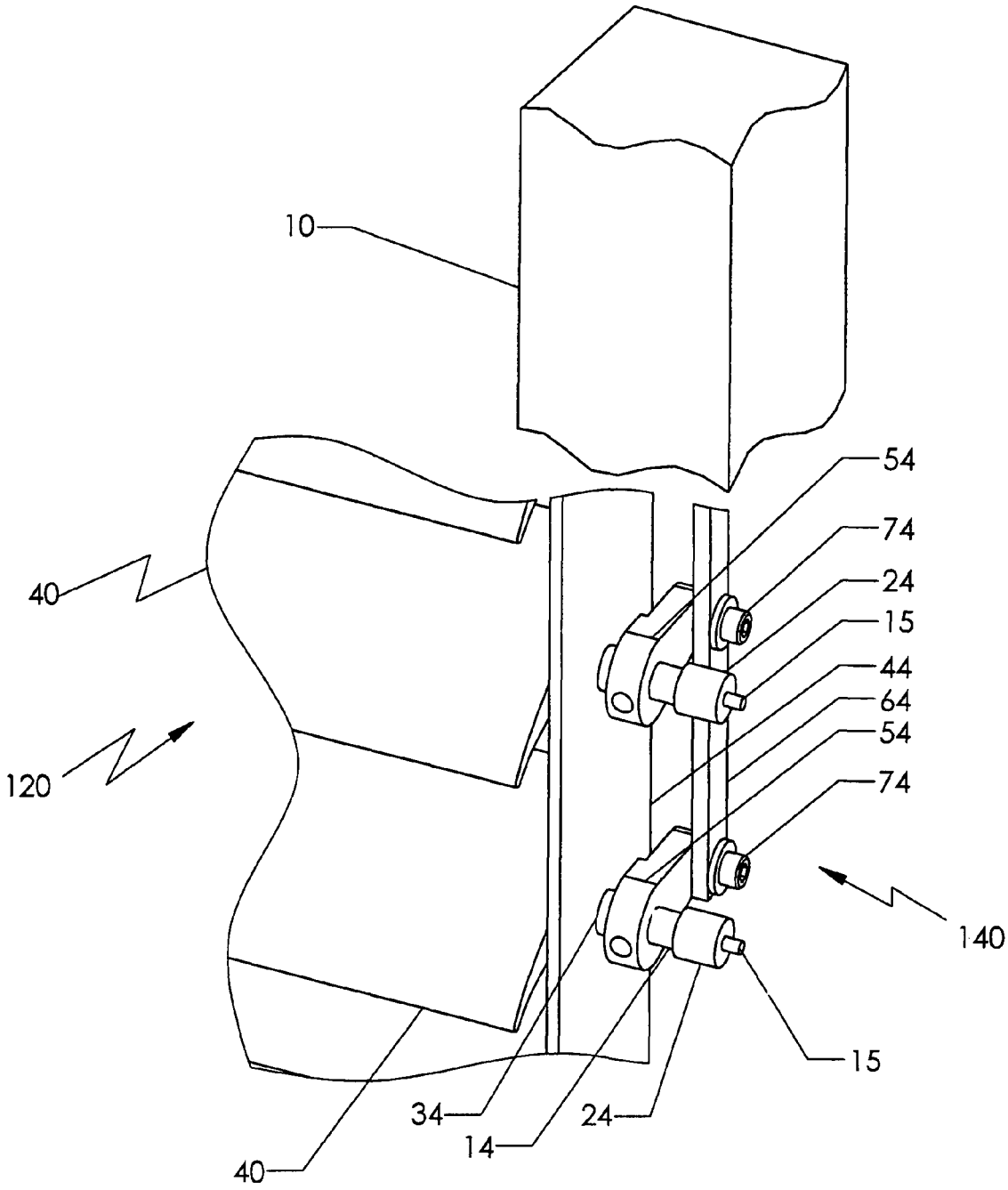
FIG. 4 is a detailed diagram of a portion of the right shutter door of FIGS. 1A-B, illustrating a hidden tilt rod mechanism for controlling movement in concert of the shutter louvers.
Figure 5:
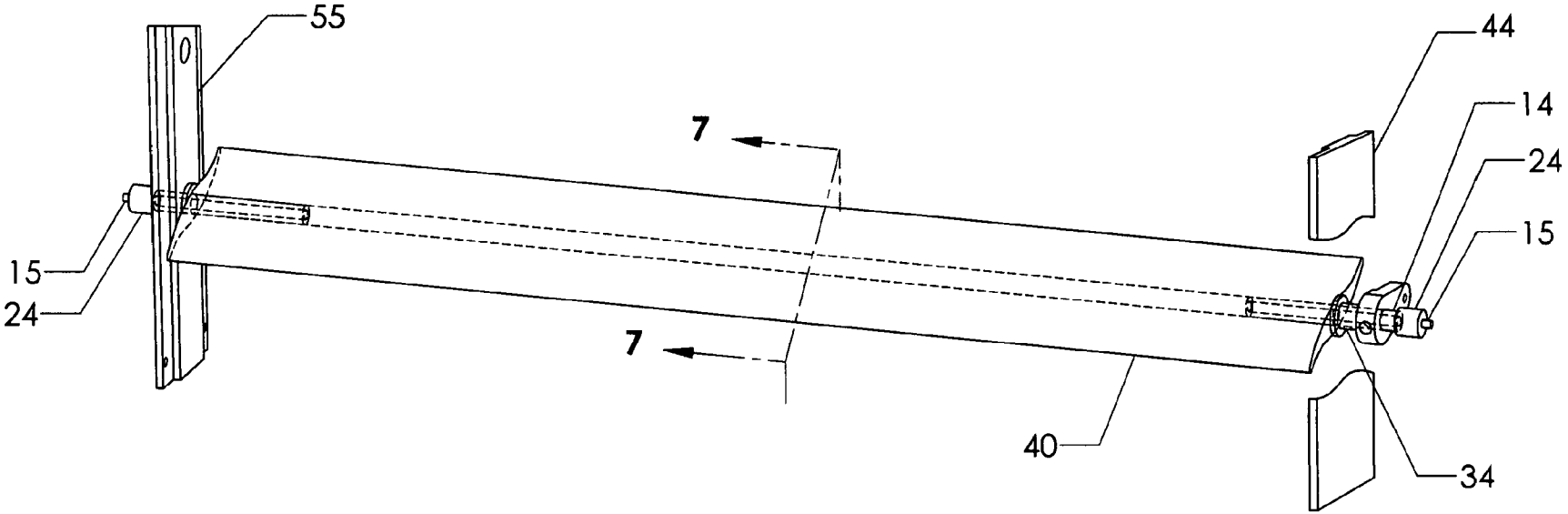
FIG. 5 is a pictorial diagram of a representative one of the shutter louvers illustrating the way in which it is mounted to pivot strips within the vertical stiles of each shutter door.

Referring now to FIGS. 4 and 5, there are shown the details of a louver tilt rod mechanism 140 associated with right shutter door 120. Although not illustrated, louver tilt rod mechanism 140 is duplicated in left shutter door 110. As shown in connection with right shutter door 120, louver tilt rod mechanism 140 is attached to and hidden from view behind vertical stile 10. A vertically-positioned pivot strip 44, having a plurality of equally-spaced holes along the length thereof, is mounted to vertical stile 10. A second pivot strip 55, like pivot strip 44, is mounted to and covered by vertical stile 20 such that the holes in each of the pivot strips 44, 55 are in horizontal alignment. Each pair of horizontally-aligned holes receives a pivot tube 14 fixedly mounted on each end of a corresponding one of the louvers 40. Each of the pivot tubes 14 passes through a pivot bearing 34 mounted on pivot strips 44, 55 to facilitate rotation of each of the louvers 40. A link 54 is secured to each of the pivot tubes 14 that extend through pivot strip 44. Each of the links 54 is coupled for rotation to a tilt rod 64 by means of a shoulder screw 74. By coupling each of the links 54 to tilt rod 64, user adjustment of one of the louvers 40 to a desired position results in movement of all of the louvers 40 in concert.

Referring now more specifically to FIG. 5, there is shown a typical one of the louvers 40 connected between pivot strips 44, 55. A hardened steel wire rope 15 of the type commercially available is passed through a central longitudinal opening in each of the louvers 40 and through the pivot tubes 14 at each end thereof. Wire rope 15 is retained at each end by a sleeve 24 outside of pivot strips 44, 55 that are secured to respective ones of the vertical stiles 10, 20. The presence of wire rope 15 adds to the security presented by shutter assembly 100 since an attempt to bend any of the louvers 40 would require the unlikely bending of vertical stiles 10, 20 as well. Wire rope 15 acts as a further deterrent to forced entry because of its tendency to rotate and bind when contacted by a saw blade.

Figure 6:
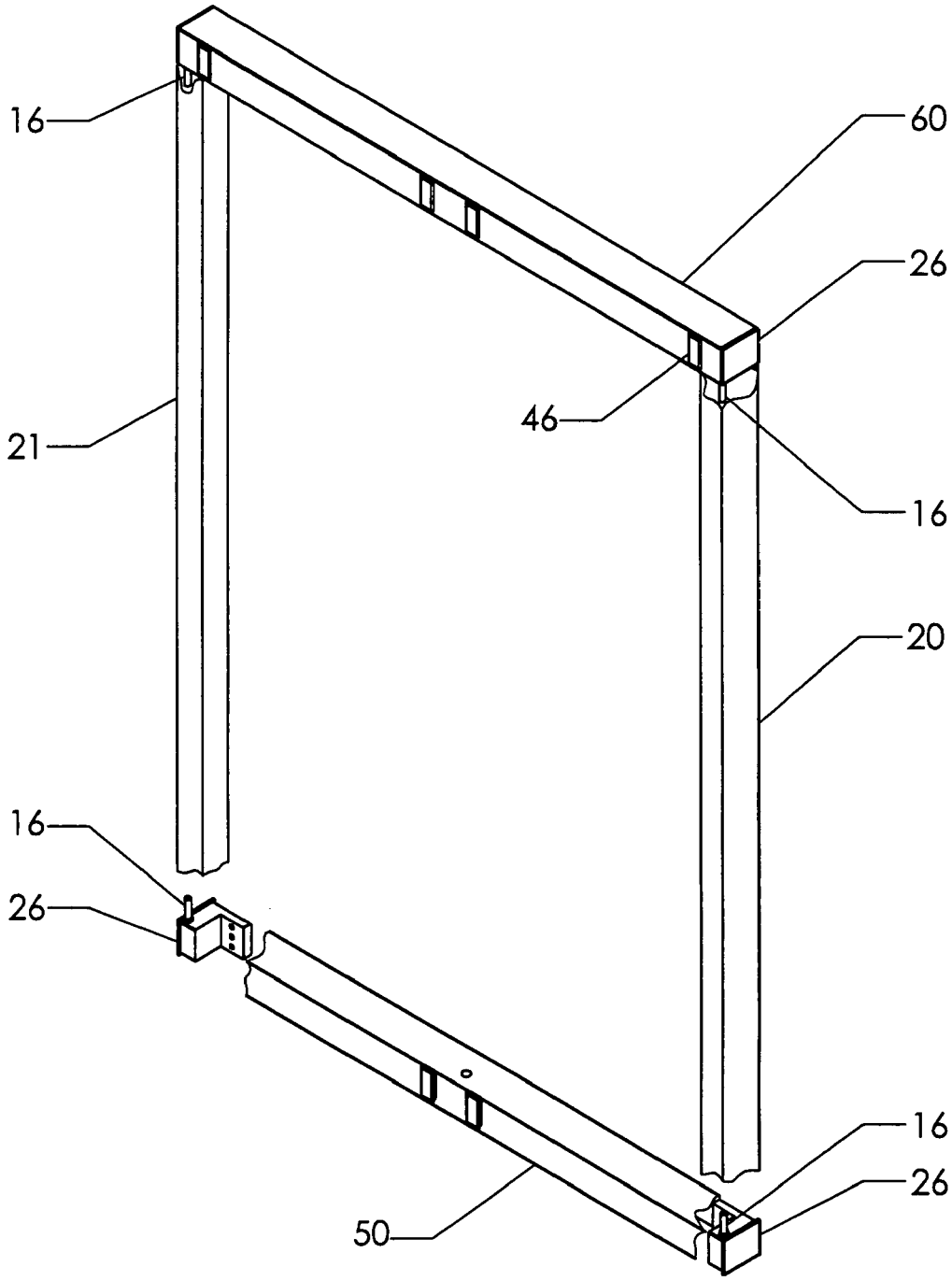
FIG. 6 is a pictorial diagram illustrating portions of the upper and lower horizontal frame members of the shutter assembly of FIGS. 1A-B and the hinge blocks retained therein for receiving the left and right shutter doors.

Referring now to FIG. 6, there are shown the details of the way in which vertical stiles 21, 20 of shutters doors 110, 120, respectively, are hingedly attached between lower and upper horizontal frame members 50, 60. A reinforced corner block 26 is attached inside each end of the horizontal frame members 50, 60. A protruding hinge pin 16 is provided in each of the corner blocks 26 to matingly engage openings at each end of the vertical stiles 21, 20. Plugs 46 serve to cover the access openings in horizontal frame members 50, 60 following attachment of corner blocks 26. As shown and described, the structure that provides hinged attachment of shutter doors 110, 120 to horizontal frame members 50, 60 is completely hidden from view and provides greater security, durability, and rigidity than existing shutter hinges.

Figure 7:
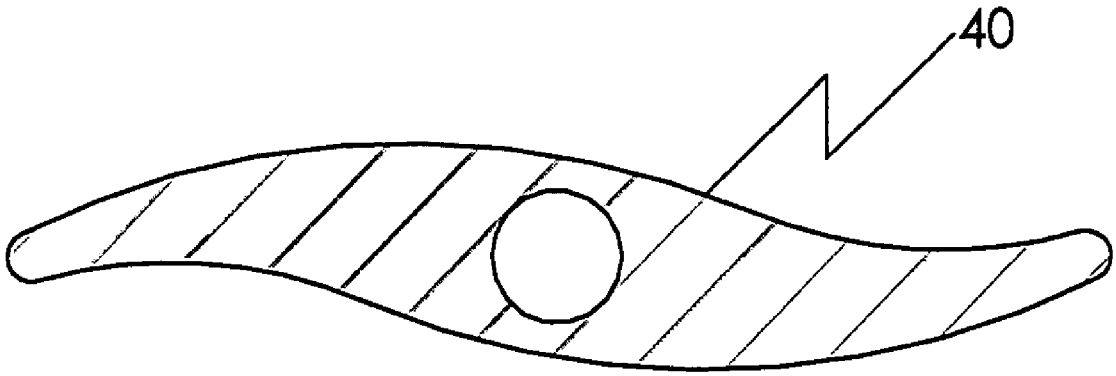
FIG. 7 is a pictorial diagram illustrating a preferred shape of each of the louvers of the shutter assembly.

Referring now to the cross-sectional diagram of FIG. 7, there is shown one of the louvers 40 shaped to be attractive but to also provide a light barrier when the louvers 40 are in their closed position. The shallow s-curve surface shape of each of the louvers 40 lends itself to fabrication of louvers 40 by employing conventional metal extrusion processes.

While the preceding description has focused on the right door 120 of shutter assembly 100, it should be understood that, except for the portions of latching mechanism 130 attached to right shutter door 120 and flange 11 thereof, the structural details of both left and right shutter doors 110, 120 are identical.

We claim:

1. A security shutter assembly comprising:

upper and lower horizontal frame members secured to framework surrounding an opening to be shuttered;

left and right shutter doors each having left and right vertical stiles forming left and right frame members of each of said left and right shutter doors, said left vertical stile of said left shutter door and said right vertical stile of said right shutter door being hingedly mounted between said upper and lower horizontal frame members, said left vertical stile of said right shutter door having a vertical flange for engaging and securing said right vertical stile of said left shutter door when said left and right shutter doors are in a closed and locked position;

a plurality of horizontal louvers pivotally mounted between said left and right stiles of each of said left and right shutter doors, each of said plurality of louvers having a central longitudinal opening therein;

a security member retained within said central longitudinal opening of a selected one or more of said plurality of louvers;

a latch socket block mounted to said framework within said upper horizontal frame member so as to be hidden from view;

a latch actuator block mounted to said framework within said lower horizontal frame member so as to be hidden from view, said latch actuator block being mounted in general vertical alignment with said latch socket block; and a shot pin latching mechanism vertically positioned between said latch socket block and said latch actuator block to secure said left and right shutter doors in said closed and locked position, said shot pin latching mechanism comprising:

a vertical shot pin mounted to said left vertical stile of said right shutter door behind said vertical flange, said shot pin extending upwardly from said latch actuator block when said left and right shutter doors are in a closed position; and a latch handle mounted on said latch actuator block, said latch handle being accessible through an opening in a bottom surface of said lower horizontal frame member, said latch handle being linked to a plunger to provide upward and downward travel of said plunger, said plunger being positioned for engaging a bottom end of said shot pin in response to locking actuation of said latch handle to thereby raise said shot pin into a position of engagement of a top end thereof with said latch socket block to thereby secure said left and right shutter doors in said closed and locked position, said latch handle being concealed from view behind said lower horizontal frame member when said left and right shutter doors are in said closed and locked position, said latch handle being operative for unlocking actuation thereof to move said plunger away from engagement with said bottom end of said shot pin, thus permitting said shot pin to gravitationally move to a position of disengagement of said top end thereof from said latch socket block, thereby unlocking said left and right shutter doors, said latch handle extending below said lower horizontal frame member in a viewable position when said left and right shutter doors are unlocked.

2. A security shutter assembly as in claim 1, wherein said security member retained within said central longitudinal opening of selected ones of said plurality of louvers comprises a wire rope member.

3. A security shutter assembly as in claim 2, wherein said wire rope member comprises a hardened steel wire rope.

4. A security shutter assembly as in claim 1, further comprising a pair of tilt rod mechanisms, one of said tilt rod mechanisms being positioned behind said left vertical stile of said left shutter door and the other one of said tilt rod mechanisms being positioned behind said right vertical stile of said right shutter door, each of said tilt rod mechanisms linking said plurality of louvers of a respective one of said left and right shutter doors for pivotal movement in concert.

5. A security shutter assembly as in claim 1, further comprising a corner hinge block mounted inside said upper and lower horizontal frame members at each end thereof, each corner hinge block being concealed from view within said upper and lower horizontal frame members, each corner hinge block having a protruding hinge pin mounted therein for matingly engaging openings at upper and lower ends of said left vertical stile of said left shutter door and said right vertical stile of said right shutter door.

6. A security shutter assembly as in claim 1, wherein top and bottom surfaces of each of said plurality of horizontal louvers are curved in shape.

7. A security shutter assembly comprising:

upper and lower horizontal frame members secured to framework surrounding an opening to be shuttered;

left and right shutter doors each having left and right vertical stiles forming left and right frame members of each of said left and right shutter doors, said left vertical stile of said left shutter door and said right vertical stile of said right shutter door being hingedly mounted between said upper and lower horizontal frame members, said left vertical stile of said right shutter door having a vertical flange for engaging and securing said right vertical stile of said left shutter door when said left and right shutter doors are in a closed and locked position;

a latch socket block mounted to said framework within said upper horizontal frame member so as to be hidden from view;

a latch actuator block mounted to said framework within said lower horizontal frame member so as to be hidden from view, said latch actuator block being mounted in general vertical alignment with said latch socket block; and a shot pin latching mechanism vertically positioned between said latch socket block and said latch actuator block to secure said left and right shutter doors in said closed and locked position, said shot pin latching mechanism comprising:

a vertical shot pin mounted to said left vertical stile of said right shutter door behind said vertical flange, said shot pin extending upwardly from said latch actuator block when said left and right shutter doors are in a closed position;

a latch handle mounted on said latch actuator block, said latch handle being accessible through an opening in a bottom surface of said lower horizontal frame member, said latch handle being linked to a plunger to provide upward and downward travel of said plunger, said plunger being positioned for engaging a bottom end of said shot pin in response to locking actuation of said latch handle to thereby raise said shot pin into a position of engagement of a top end thereof with said latch socket block to thereby secure said left and right shutter doors in said closed and locked position, said latch handle being concealed from view behind said lower horizontal frame member when said left and right shutter doors are in said closed and locked position, said latch handle being operative for unlocking actuation thereof to move said plunger away from engagement with said bottom end of said shot pin, thus permitting said shot pin to gravitationally move to a position of disengagement of said top end thereof from said latch socket block, thereby unlocking said left and right shutter doors, said latch handle extending below said lower horizontal frame member in a viewable position when said left and right shutter doors are unlocked.

8. A security shutter assembly as in claim 7, further comprising a corner hinge block mounted inside said upper and lower horizontal frame members at each end thereof, each corner hinge block being concealed from view within said upper and lower horizontal frame members, each corner hinge block having a protruding hinge pin mounted therein for matingly engaging openings at upper and lower ends of said left vertical stile of said left shutter door and said right vertical stile of said right shutter door.

9. A security shutter assembly comprising:

upper and lower horizontal frame members secured to framework surrounding an opening to be shuttered;

a shutter door having left and right vertical stiles forming left and right frame members thereof, a selected one of said left and right vertical stiles being hingedly mounted between said upper and lower horizontal frame members at an end thereof that is proximate said selected one of said left and right vertical stiles, a remaining one of said left and right vertical stiles having an outwardly protruding vertical flange;

a plurality of horizontal louvers pivotally mounted between said left and right stiles of said shutter door, each of said plurality of louvers having a central longitudinal opening therein;

a security member retained within said central longitudinal opening of a selected one or more of said plurality of louvers;

a latch socket block mounted to said framework within said upper horizontal frame member so as to be hidden from view;

a latch actuator block mounted to said framework within said lower horizontal frame member so as to be hidden from view, said latch actuator block being mounted in general vertical alignment with said latch socket block; and a shot pin latching mechanism vertically positioned between said latch socket block and said latch actuator block, behind said vertical flange, to secure said shutter door in a closed and locked position, said shot pin latching mechanism comprising:

a vertical shot pin mounted to said remaining one of said left and right vertical stiles of said shutter door behind said vertical flange, said shot pin extending upwardly from said latch actuator block when said shutter door is in a closed position; and a latch handle mounted on said latch actuator block, said latch handle being accessible through an opening in a bottom surface of said lower horizontal frame member, said latch handle being linked to a plunger to provide upward and downward travel of said plunger, said plunger being positioned for engaging a bottom end of said shot pin in response to locking actuation of said latch handle to thereby raise said shot pin into a position of engagement of a top end thereof with said latch socket block and to thereby secure said shutter door in said closed and locked position, said latch handle being concealed from view behind said lower horizontal frame member when said shutter door is in said closed and locked position, said latch handle being operative for unlocking actuation thereof to move said plunger away from engagement with said bottom end of said shot pin, thus permitting said shot pin to gravitationally move to a position of disengagement of said top end thereof from said latch socket block, thereby unlocking said shutter door, said latch handle extending below said lower horizontal frame member in a viewable position when said shutter door is unlocked.

10. A security shutter assembly as in claim 9, wherein said security member retained within said central longitudinal opening of selected ones of said plurality of louvers comprises a wire rope member.

11. A security shutter assembly as in claim 10, wherein said wire rope member comprises a hardened steel wire rope.

12. A security shutter assembly as in claim 9, further comprising a tilt rod mechanism, said tilt rod mechanism being positioned behind said remaining one of said left and right vertical stiles of said shutter door, said tilt rod mechanism linking said plurality of louvers of said shutter door for pivotal movement in concert.

13. A security shutter assembly as in claim 9, further comprising a corner hinge block mounted inside said upper and lower horizontal frame members at said end thereof that is proximate said selected one of said left and right vertical stiles, said corner hinge block being concealed from view within said upper and lower horizontal frame members, said corner hinge block having a protruding hinge pin mounted therein for matingly engaging openings at upper and lower ends of said selected one of said left and right vertical stiles of said shutter door.

14. A security shutter assembly as in claim 9, wherein top and bottom surfaces of each of said plurality of horizontal louvers are curved in shape.

15. A security shutter assembly comprising:

upper and lower horizontal frame members secured to framework surrounding an opening to be shuttered;

a shutter door having left and right vertical stiles forming left and right frame members thereof, a selected one of said left and right vertical stiles being hingedly mounted between said upper and lower horizontal frame members at an end thereof that is proximate said selected one of said left and right vertical stiles, a remaining one of said left and right vertical stiles having an outwardly protruding vertical flange;

a latch socket block mounted to said framework within said upper horizontal frame member so as to be hidden from view;

a latch actuator block mounted to said framework within said lower horizontal frame member so as to be hidden from view, said latch actuator block being mounted in general vertical alignment with said latch socket block; and a shot pin latching mechanism vertically positioned between said latch socket block and said latch actuator block, behind said vertical flange, to secure said shutter door in a closed and locked position, said shot pin latching mechanism comprising:

a vertical shot pin mounted to said remaining one of said left and right vertical stiles of said shutter door behind said vertical flange, said shot pin extending upwardly from said latch actuator block when said shutter door is in a closed position; and a latch handle mounted on said latch actuator block, said latch handle being accessible through an opening in a bottom surface of said lower horizontal frame member, said latch handle being linked to a plunger to provide upward and downward travel of said plunger, said plunger being positioned for engaging a bottom end of said shot pin in response to locking actuation of said latch handle to thereby raise said shot pin into a position of engagement of a top end thereof with said latch socket block and to thereby secure said shutter door in said closed and locked position, said latch handle being concealed from view behind said lower horizontal frame member when said shutter door is in said closed and locked position, said latch handle being operative for unlocking actuation thereof to move said plunger away from engagement with said bottom end of said shot pin, thus permitting said shot pin to gravitationally move to a position of disengagement of said top end thereof from said latch socket block, thereby unlocking said shutter door, said latch handle extending below said lower horizontal frame member in a viewable position when said shutter door is unlocked.

16. A security shutter assembly as in claim 15, further comprising a corner hinge block mounted inside said upper and lower horizontal frame members at said end thereof that is proximate said selected one of said left and right vertical stiles, said corner hinge block being concealed from view within said upper and lower horizontal frame members, said corner hinge block having a protruding hinge pin mounted therein for matingly engaging openings at upper and lower ends of said selected one of said left and right vertical stiles of said shutter door.

* * * * *